US008205604B2

(12) United States Patent
Velosa et al.

(10) Patent No.: US 8,205,604 B2
(45) Date of Patent: Jun. 26, 2012

(54) CRANKCASE VENT NOZZLE FOR INTERNAL COMBUSTION ENGINE

(75) Inventors: Julian Velosa, Novi, MI (US); Mark S. Huebler, Shelby Township, Macomb County, MI (US); Carl Raymond Hunsanger, Clinton Township, MI (US); Jonathan Pung, Auburn Hills, MI (US); Stephen W Farrar, Linden, MI (US); Laun M Johnson, Eastpointe, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 408 days.

(21) Appl. No.: 12/626,020

(22) Filed: Nov. 25, 2009

(65) Prior Publication Data

US 2011/0120397 A1 May 26, 2011

(51) Int. Cl.
*F02B 25/06* (2006.01)

(52) U.S. Cl. ... 123/572; 123/573; 123/574; 123/184.21; 123/184.61

(58) Field of Classification Search ..... 123/572, 123/573, 574, 184.21, 184.61
See application file for complete search history.

(56) References Cited

U.S. PATENT DOCUMENTS

| | | | | |
|---|---|---|---|---|
| 6,234,154 | B1 | 5/2001 | Spix | |
| 6,729,316 | B1 * | 5/2004 | Knowles | 123/572 |
| 2002/0002968 | A1 * | 1/2002 | Gillespie | 123/572 |
| 2011/0139098 | A1 * | 6/2011 | Nelander et al. | 123/41.86 |

* cited by examiner

*Primary Examiner* — Marguerite McMahon
*Assistant Examiner* — James Kim
(74) *Attorney, Agent, or Firm* — Cantor Colburn LLP

(57) ABSTRACT

A crankcase ventilation system is provided. The crankcase ventilation system is fluidly coupled between an engine block assembly and an axially extending air inlet adapter. A crankcase vent nozzle is provided as one aspect of the system and extends into the air inlet adapter. The crankcase vent nozzle has a leading edge portion and a trailing edge portion extending radially into an axially extending flow path in the air inlet adapter. The trailing edge portion extending further into the flow path than the leading edge portion.

17 Claims, 3 Drawing Sheets

CRANKCASE VENT NOZZLE FOR INTERNAL COMBUSTION ENGINE

FIELD OF THE INVENTION

Exemplary embodiments of the present invention are related to an engine ventilation system regardless of technical definition such as a closed crankcase ventilation (CCV) system generally used for Diesel engine applications or positive crankcase ventilation (PCV) system and, more specifically, to a vent nozzle for the system.

BACKGROUND

During engine operation, combustion gas may leak between the cylinder and its piston rings into the engine crankcase. The leaked combustion gas is referred to as piston blowby gas and may comprise unburned intake air/fuel mixture, exhaust gas, oil mist, and water vapor.

A crankcase ventilation system be it PCV or CCV, is typically employed to ventilate the crankcase and recirculate the blowby gas to the intake side of the engine for burning the gas in the combustion chamber. The PCV/CCV system takes advantage of the negative pressure in the intake to draw the gas out of the crankcase and may utilize a PCV/CCV valve to regulate the flow.

At low ambient temperatures, such as in cold weather climates, a common concern is freezing of the water vapor component of the blowby gas in the PCV/CCV system. To minimize the risk of freezing, some PCV/CCV systems may include a PCV/CCV heater, an extra hot water-carrying hose routed adjacent the PCV/CCV hose, or electrically heating or insulating the PCV/CCV hose. Each of these solutions add a significant additional cost to a PCV/CCV system. Furthermore, the system might not be necessary in the operating environment of the moment, but the system must be capable of operating at all design temperature extremes.

Even with some heating systems, freezing can still occur at the outlet of the PCV/CCV system where blowby gas is introduced into the intake side of the engine. Ice build-up at this location can damage engine components downstream, such as a turbocharger compressor/impeller wheel or throttle control valve. Even if damage is avoided, ice-build-up can cause restrictions in the engine intake which may affect engine performance or fuel economy.

As such, the need exists for a simple PCV/CCV system that reduces or eliminates ice build-up in low ambient temperature environments without adding substantial cost or complexity to the engine.

SUMMARY OF THE INVENTION

Accordingly, a nozzle has been developed to reduce or prevent ice formation inside of the engine air intake. The nozzle disperses water inside the air inlet adapter and has an aerodynamic shape to prevent the occurrence of concentrated ice formations on the wall of the inlet adapter.

According to one aspect of the invention, a crankcase ventilation system (PCV/CCV) is provided. The PCV/CCV system is fluidly coupled between an engine block assembly and an axially extending air inlet adapter. A PCV/CCV nozzle is provided as one aspect of the system and extends into the air inlet adapter. The PCV/CCV nozzle has a leading edge portion and a trailing edge portion extending radially into an axially extending flow path in the air inlet adapter, the leading edge portion axially upstream of the trailing edge portion. The PCV/CCV nozzle further includes an outer surface and an inner surface, the outer surface has a first portion that is adjacent the leading edge portion and the first portion radially extends into the flow path at the upstream side of the axially extending flow path at a first length. The inner surface has an upstream facing portion that is adjacent the trailing edge portion and the upstream facing portion extends radially into the upstream side of the axially extending flow path at a second length, the first length being less than the second length.

According to another aspect of the invention, a positive crankcase ventilation nozzle is provided. It comprises a flange, a nozzle edge opposite the flange and an air foil portion. The airfoil portion extends between the flange and the nozzle edge. The airfoil portion includes a leading edge portion having at least a first length extending between the flange and the nozzle edge and a trailing edge portion having at least a second length extending between the flange and the nozzle edge, the first length being less than the second length.

According to yet another aspect of the invention, an internal combustion engine assembly having crankcase ventilation (PCV/CCV) is provided. The internal combustion engine assembly comprises an engine block assembly including an axially extending inlet adapter having an upstream portion for feeding air gases into a manifold fluidly coupled to a downstream portion of the inlet adapter. The engine assembly further comprises a PCV/CCV system fluidly coupled to the engine block assembly and the air inlet adapter and a PCV/CCV nozzle being fluidly coupled to the PCV/CCV system. The PCV/CCV nozzle comprises an airfoil portion have a leading edge portion extending radially into the air inlet adapter at a first length the upstream portion and a trailing edge portion extending radially into the air inlet adapter at a second length of the downstream portion, the first length being less then the second length.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
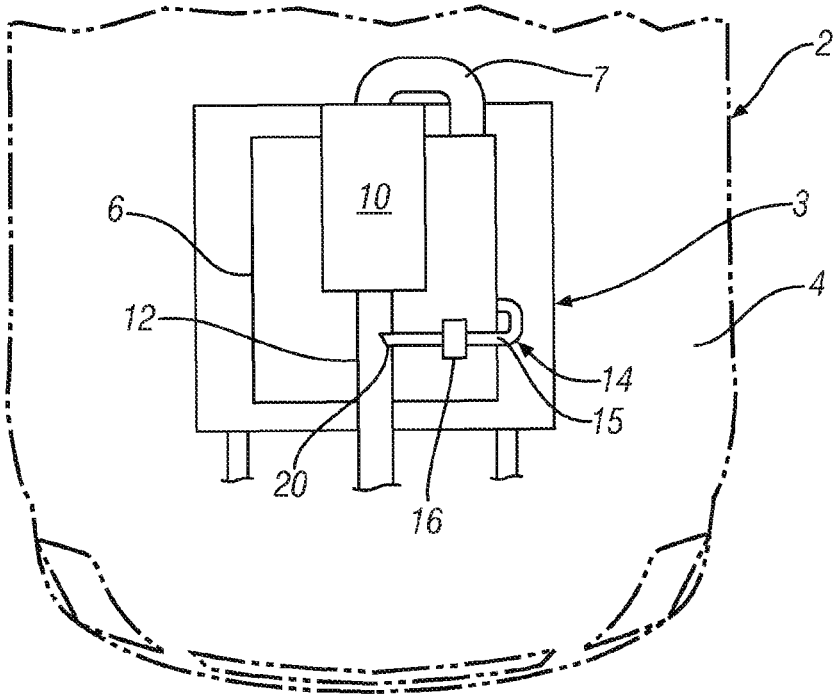
FIG. 1 is a functional block diagram showing the internal combustion engine and the PCV/CCV system of the invention.

Referring now to the Figures, where the invention will be described with reference to specific embodiments, without limiting same, a functional diagram of a vehicle 2 having an internal combustion engine block assembly 3 located within an engine compartment 4 is shown in FIG. 1. An air intake manifold 6, having a gas intake plenum 7 is fluidly coupled to a turbocharger 10. Air intake manifold 6 generally includes a plurality of gas outlets (not shown) that are fluidly connected to engine block assembly 3. Specifically, an air intake system or air inlet adapter 12 feeds air gases into a turbocharger 10 where the gases are pressurized and flow from air intake manifold 6 to the engine block assembly 3. A crankcase ventilation (PCV/CCV) system 14 is used to ventilate the crankcase and recirculate blowby gas from an inlet tube 15 through a PCV/CCV valve 16 and out through a nozzle 20 to the turbocharger inlet adapter 12. As is known, the introduction of blowby gas to the inlet adapter 12 from the crankcase through the turbocharger 10, or in other exemplary embodiments through a throttle control valve (not shown), aids in efficiency of the engine and reduction of emissions from the engine.

Figure 2:
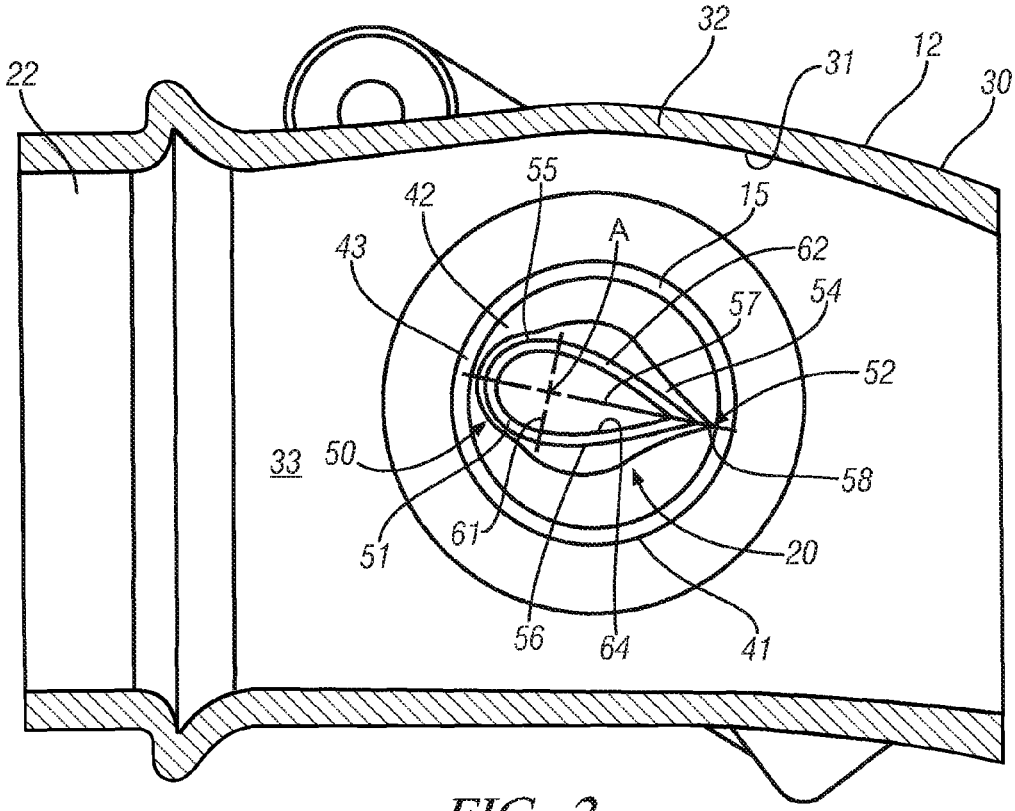
FIG. 2 is a pictorial view, in cross-section, of an exemplary embodiment of the nozzle of the invention.
Figure 3:
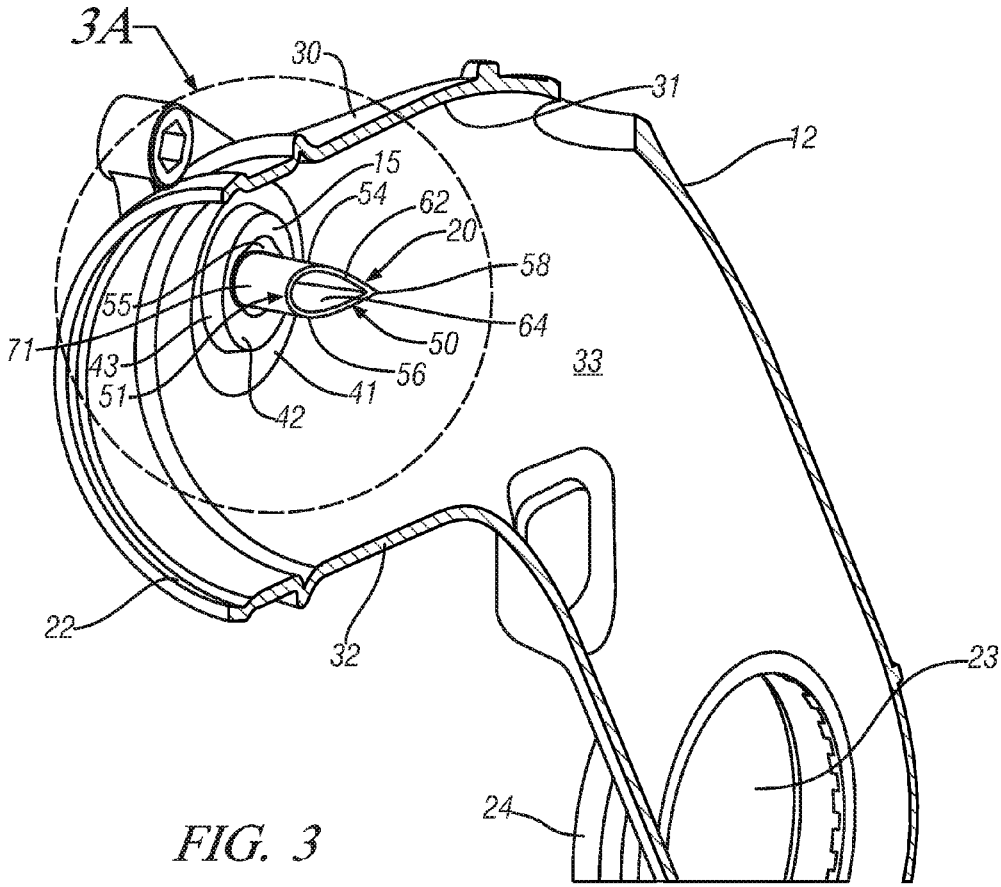
FIG. 3 is a pictorial view, in cross-section, of the inlet adapter in accordance with one exemplary embodiment of the invention.
Figure 4:
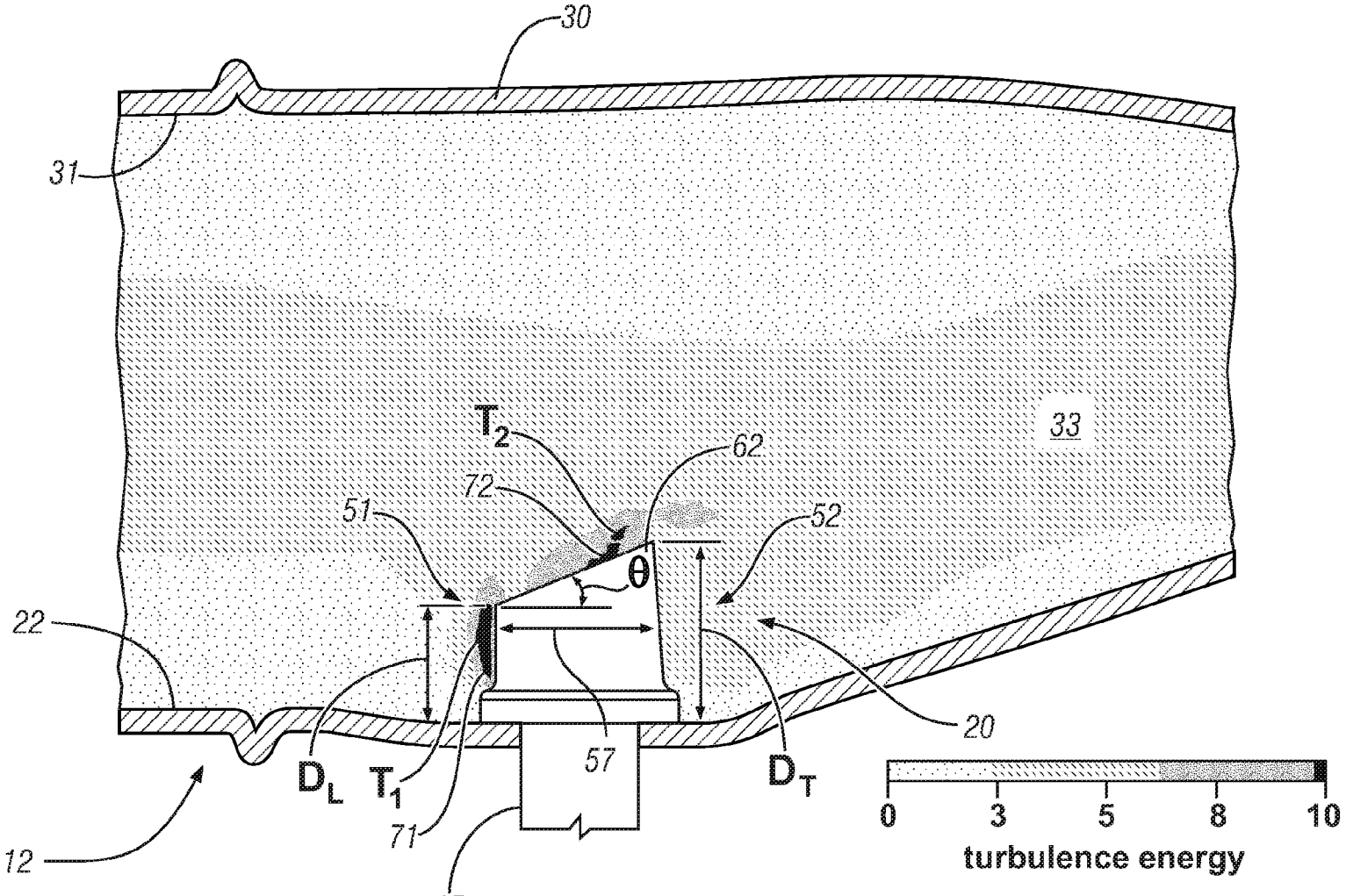
FIG. 4 is another view, in cross-section, of an exemplary embodiment of the nozzle of the invention.

Referring now to FIGS. 2 through 4, various pictorial cross-sections of the turbocharger inlet adapter 12 are shown. Inlet adapter 12 is generally cylindrical in shape and axially extends between an air intake side 22 and an outlet 23 defining a generally axially extending fluid flow path. The outlet 23 terminates in a flange 24 for communicating with a compressor wheel (not shown) for turbocharger 10. Cylindrical inlet adapter 12 has an outer shell surface 30 and an inner shell surface 31 forming a cylindrical wall 32.

PCV/CCV system 14 is fluidly connected to inlet adapter 12 at inlet tube 15, which extends through cylindrical wall 32. The nozzle 20, located within an interior 33 of inlet adapter 12 is fitted over a portion of inlet tube 15 and serves as the termination point of PCV/CCV system 14. Obviously, many other variants of connecting nozzle 20 to inlet tube 15 may be used, including molding nozzle 20 and inlet tube 15 as a single piece part, or fitting nozzle 20 on the end of inlet tube 15 and spin welding the parts together. Thereafter, nozzle 20 may be driven through an opening through cylindrical wall 32 of inlet adapter 12 to retain nozzle 20 within the interior 33 of inlet adapter 12.

In the non-limiting exemplary embodiment shown, nozzle 20 has a flange 41 fitted over and sealing an opening (not shown) extending through cylindrical wall 32. Flange 41 includes a generally planar surface 42 and a circumferential edge surface 43 extending between generally planar surface 42 and inner shell surface 31 of inlet adapter 12. Extending into a flow path between air intake side 22 and outlet 23 of inlet adapter 12 is an airfoil portion 50 of nozzle 20. Airfoil portion 50 extends along an axis A that is generally orthogonal to planar surface 42 of flange 41. Airfoil portion 50 includes a rounded leading edge portion 51 at an upstream portion of the flow path and a trailing edge portion 52 at a downstream portion of the flow path, the trailing edge portion 52 terminating at an end tail edge 58.

The outer surface 54 of airfoil portion 50 is comprised of a first camber surface 55 and a second camber surface 56. First and second camber surfaces 55 and 56 intersect at a chord line 57 which is the longest distance between leading edge portion 51 and trailing edge portion 52. In the exemplary embodiment shown, airfoil portion 50 is symmetrical such that first and second camber surfaces are generally equal in length and chord line 57 intersects axis A. It will be appreciated that airfoil portion 50 may be asymmetric as well, depending on the flow characteristics that are desired across nozzle 20. Airfoil portion 50 has a maximum width along line 61, that is perpendicular to chord line 57 and generally separates leading edge portion 51 from trailing edge portion 52. In the exemplary embodiment shown, the maximum width along line 61 is about one-half the length of chord line 57. However, it will be appreciated that the dimensions may vary so long as the desired flow characteristics, as discussed herein, are achieved.

Turning now to FIG. 4, a partial sectional view of turbocharger inlet adapter 12 is shown with nozzle 20, as seen from a side view. Airfoil portion 50 is arranged such that leading edge portion 51 extends into the flow path at the upstream end 22 of inlet adapter 12 to a lesser extent than the trailing edge portion 52 extends into the same flow path. As shown, leading edge portion 51 extends radially into interior 33 of inlet adapter 12 at a length $D_L$, while trailing edge portion 52 extends into radially into interior 33 of inlet adapter 12 at a length $D_T$. The outer surface 54 of airfoil portion 50 terminates at a nozzle edge 62 extending between outer surface 54 and an inner surface 64 of airfoil portion 50. Nozzle edge 62 extends along a plane at an angle θ from chord line 57 into the flow path of the air inlet adapter 12 from leading edge portion 51 to trailing edge portion 52. As seen in the exemplary embodiment shown in FIG. 4, the length $D_L$ is about ⅔ the length of $D_T$. Angle θ, shown in the non-limiting embodiment of FIG. 4 is in the range of about 15 degrees to 45 degrees. Obviously the lengths $D_T$ and $D_L$ as well as angle θ may vary due to the flow characteristics within interior 33, the flow exiting nozzle 20 and the length that airfoil portion intrudes into interior 33. These dimensions may be determined using computational fluid dynamics analysis.

Figure 3A:
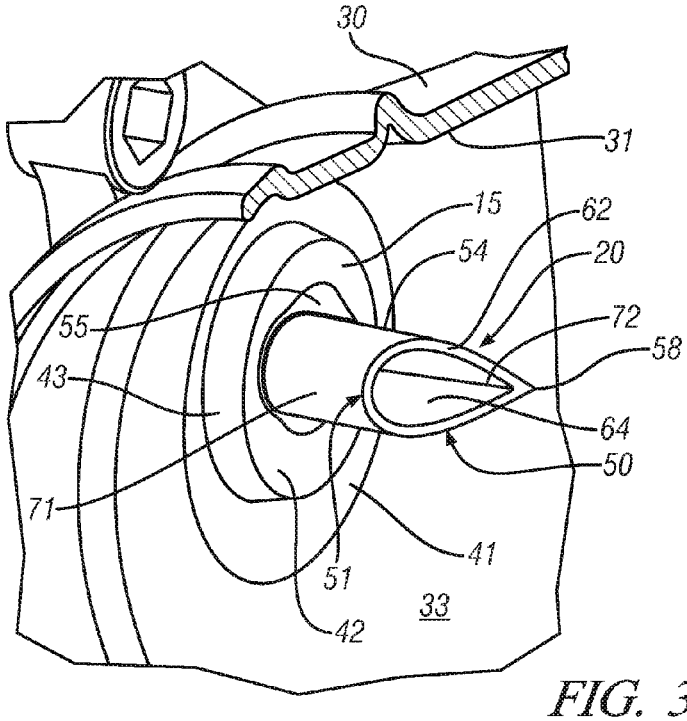
FIG. 3A is a detailed pictorial view of the nozzle shown in FIG. 3.

As best seen in FIGS. 3, 3A and 4, the outer surface 54 has a first portion 71 that is adjacent the leading edge portion 51 and the first portion radially extends into the flow path at the upstream side of the axially extending flow path at a first length $D_L$. The inner surface 64 has an upstream facing portion 72 that is adjacent the trailing edge portion 52 and the upstream facing portion extends radially into the upstream side of the axially extending flow path at a second length $D_T$. As a result, the inner surface 64 of nozzle 20, which has an upstream facing portion, radially extends further into the upstream side of the flow path than does the outer surface 54 having a first portion adjacent leading edge portion 51. As is further explained herein, this creates a turbulence which prevents ice formation in low ambient temperature conditions.

Nozzle 20, and specifically airfoil portion 50, disperses water in the flow path of turbocharger inlet adapter 12 in such a way that the water does not freeze at low ambient temperatures. As best seen in FIG. 4, the leading edge portion 51 of airfoil portion 50 creates a first area of turbulence $T_1$ (shown as shading in FIG. 4). This turbulence prevents ice formation at this location and creates a zone of turbulence across the outer surface 54 of airfoil portion 50—acting downstream toward the trailing edge portion 52. In addition, the sloped nozzle edge surface 62 creates a second distinct area of turbulence $T_2$ (show as shading in FIG. 4) at the exit of nozzle 20, and immediately interior thereof, against inner surface 64 in the area of trailing edge portion 52.

The exemplary embodiment of the nozzle 20 shown provides two distinct areas of turbulence. The areas of turbulence, across the first portion of the outer surface 54 and adjacent the upstream facing portion of the leading edge portion 51 combined with the turbulence within nozzle 20 and at the upstream facing portion of inner surface 64 adjacent trailing edge portion 52, combine to create sufficient turbulence that prevents freezing of water in the blowby gas as it exits nozzle 20. This prevents damage downstream of the inlet adapter 12 to a turbocharger compressor wheel or throttle control valve. It will be appreciated that certain aspects of the invention may function to achieve the desired result of reducing or eliminating the freezing of water. For example, in certain embodiments, it is possible to eliminate freezing water with an airfoil shape nozzle or with a nozzle that progressively extends into the flow path, two distinct features of Applicant's invention that are shown in combination in the exemplary embodiments shown.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A crankcase ventilation system fluidly coupled between an engine block assembly and an axially extending air inlet adapter comprising:

a crankcase vent nozzle extending into the air inlet adapter, the crankcase vent nozzle having a leading edge portion and a trailing edge portion extending radially into an axially extending flow path in the air inlet adapter, the leading edge portion axially upstream of the trailing edge portion, the crankcase vent nozzle further including an outer surface and an inner surface, the outer surface having a first portion that is adjacent the leading edge portion and the first portion radially extends into the flow path at the upstream side of the axially extending flow path at a first length, the inner surface having an upstream facing portion that is adjacent the trailing edge portion and the upstream facing portion extends radially into the upstream side of the axially extending flow path at a second length, the first length being less than the second length, and the trailing edge portion terminates at an end tail edge downstream in the flow path.

2. The positive crankcase ventilation system of claim 1, wherein said nozzle has a rounded leading edge extending upstream into the flow path.

3. The positive crankcase ventilation system of claim 1, wherein a chord line extends axially between the leading edge portion and the trailing edge portion such that the outer surface is symmetrical about the chord line.

4. The positive crankcase ventilation system of claim 3, wherein the outer surface and the inner surface terminate at a nozzle outlet edge, the nozzle outlet edge extending along a plane at an angle from the chord line into the air inlet adapter from the leading edge portion to the trailing edge portion.

5. The positive crankcase ventilation system of claim 4, wherein the angle is in a range of about 15 degrees to about 45 degrees.

6. A crankcase ventilation nozzle comprising:

a flange;

a nozzle outlet edge opposite said flange;

an airfoil portion including extending between said flange and said nozzle edge, the airfoil portion including a leading edge portion having at least a first length extending between the flange and the nozzle outlet edge and a trailing edge portion having at least a second length extending between the flange and the nozzle outlet edge, the first length being less than the second length, and the trailing edge portion terminates at an end tail edge downstream in the flow path.

7. The positive crankcase ventilation nozzle of claim 6, wherein a chord line extends axially between the leading edge portion and the trailing edge portion such that an outer surface of the airfoil portion is symmetrical about the chord line.

8. The positive crankcase ventilation nozzle of claim 7, wherein the outer surface and an inner surface of the airfoil portion terminates at the nozzle outlet edge, the nozzle outlet edge extending along a plane at an angle from the chord line from the leading edge portion to the trailing edge portion.

9. The positive crankcase ventilation nozzle of claim 8, wherein the angle is in a range of about 15 degrees to about 45 degrees.

10. The positive crankcase ventilation nozzle of claim 6, wherein a chord line extends axially between the leading edge portion and the trailing edge portion such that the airfoil portion is symmetrical about the chord line.

11. The positive crankcase ventilation nozzle of claim 6, wherein the leading edge of the airfoil portion has a rounded outer surface on the trailing edge of the airfoil portion terminates at an end tail edge.

12. An internal combustion engine assembly having crankcase ventilation comprising:

an engine block assembly including an axially extending air inlet adapter having an upstream portion for feeding air gases into a manifold and fluidly coupled to a downstream portion of the air inlet adapter;

a crankcase vent system fluidly coupled to the engine block assembly and the air inlet adapter;

a crankcase vent nozzle fluidly coupled to the crankcase vent system, the crankcase vent nozzle comprising an airfoil portion have a leading edge portion extending radially into the air inlet adapter at a first length and a trailing edge portion extending radially into the air inlet adapter at a second length, the first length being less then the second length, the leading edge portion upstream of the trailing edge portion, and the trailing edge portion terminates at an end tail edge downstream in the flow path.

13. The internal combustion engine assembly of claim 12, wherein the leading edge is rounded and the trailing edge terminates at an end tail edge.

14. The internal combustion engine assembly of claim 12, wherein a chord line extends, axially between the leading edge portion and the trailing edge portion such that the airfoil portion is symmetrical about the chord line.

15. The internal combustion engine assembly of claim 14, wherein the airfoil portion has an outer surface and an inner surface that terminates at a nozzle outlet edge, the nozzle outlet edge extending along a plane at an angle from the chord line into the air inlet adapter from the leading edge portion to the trailing edge portion.

16. The internal combustion engine assembly of claim 15, wherein the angle is the range of about 15 degrees to about 45 degrees.

17. The internal combustion engine assembly of claim 12, including a turbocharger located downstream of said crankcase vent nozzle.

* * * * *